US007134701B1

(12) United States Patent
Ronning

(10) Patent No.: US 7,134,701 B1
(45) Date of Patent: Nov. 14, 2006

(54) FRAME FOR LIFTING BEAMS AND OTHER ELONGATED LOADS

(76) Inventor: James M. Ronning, 6640 Galpin Blvd., Excelsior, MN (US) 55331

( * ) Notice: Subject to any disclaimer, the term of this patent is extended or adjusted under 35 U.S.C. 154(b) by 149 days.

(21) Appl. No.: 10/748,574

(22) Filed: Dec. 30, 2003

Related U.S. Application Data

(60) Provisional application No. 60/437,840, filed on Jan. 3, 2003.

(51) Int. Cl.
*B66C 1/00* (2006.01)

(52) U.S. Cl. ..... 294/67.3

(58) Field of Classification Search ..... 294/67.1, 294/67.31, 67.5, 81.2, 81.51, 81.55, 81.56, 294/81.21, 82.16
See application file for complete search history.

(56) References Cited

U.S. PATENT DOCUMENTS

| | | | | |
|---|---|---|---|---|
| 430,642 | A | 6/1890 | Hale | |
| 696,413 | A | 4/1902 | Dalrymple | |
| 897,966 | A | 9/1908 | Elsing | |
| 1,177,559 | A | 3/1916 | Wigle | |
| 1,704,109 | A | 3/1929 | Speck et al. | |
| 1,723,086 | A | 8/1929 | Smith | |
| 1,842,638 | A * | 1/1932 | Wigle | 294/82.16 |
| 2,441,026 | A * | 5/1948 | Long | 294/110.1 |
| 2,500,459 | A | 3/1950 | Hoover et al. | 267/1 |
| 2,675,198 | A | 4/1954 | Reihman | |
| 2,695,809 | A * | 11/1954 | Hooker | 294/81.51 |
| 2,761,725 | A | 9/1956 | Rushing | |
| 2,841,434 | A * | 7/1958 | Hooker et al. | 294/67.31 |
| 2,959,411 | A * | 11/1960 | Kaplan | 267/71 |
| 3,010,751 | A | 11/1961 | Day et al. | |
| 3,044,819 | A * | 7/1962 | Simon | 294/88 |
| 3,086,808 | A * | 4/1963 | Kaplan | 294/67.31 |
| 3,792,787 | A | 2/1974 | Maloney | 214/152 |
| 3,870,356 | A | 3/1975 | Meads | 294/67 |
| 4,044,894 | A | 8/1977 | McDonald et al. | 214/1 |
| 4,286,817 | A * | 9/1981 | Moritz | 294/67.21 |
| 4,360,110 | A * | 11/1982 | Sigman et al. | 212/318 |
| 4,397,493 | A | 8/1983 | Khachaturian et al. | 294/81 |
| 4,402,541 | A | 9/1983 | Bomberger et al. | 294/81 |
| 4,416,480 | A | 11/1983 | Moody | 291/83 |

(Continued)

FOREIGN PATENT DOCUMENTS

| | | |
|---|---|---|
| EP | 0 560 607 | 3/1993 |

*Primary Examiner*—Eileen D. Lillis
*Assistant Examiner*—Esther Onyinyechi Okezie
(74) *Attorney, Agent, or Firm*—Nickolas E. Westman; Westman, Champlin & Kelly, P.A.

(57) ABSTRACT

A lift frame adapted to be pivotally mounted on a hoist include a tubular sleeve guide that guides a lift slide. The lift slide carries a lift frame for supporting a load such as a beam or truss to be lifted, and is spring loaded in an upward direction by a spring extending between a slider tube and the lift frame. The spring keeps the bracket seated on the load for a limited distance along the lift path. The lift slide has a stop that limits the amount of downward movement of the lift slide relative to the guide as the load is lifted. Specifically, a pair of frames are mounted at opposite ends of a spreader bar for lifting an elongated beam. A bracket on each lift slide engages one end of the beam and supports it under spring load for a selected amount of vertical travel, and thereafter the beam or load is directly lifted mechanically by having the stop on the lift slide engaging the sleeve guide.

7 Claims, 7 Drawing Sheets

U.S. PATENT DOCUMENTS 4,438,910 A * 3/1984 McFadden ..... 267/126
4,475,755 A 10/1984 Patton ..... 291/82
4,489,970 A * 12/1984 Henke ..... 294/67.22
4,498,698 A 2/1985 Zimmermann ..... 291/82
4,542,928 A * 9/1985 Fowler, Jr. ..... 294/81.1
4,671,724 A 6/1987 Bolton ..... 414/126
4,925,015 A 5/1990 Vaida et al. ..... 198/803.7
4,969,789 A 11/1990 Searle ..... 414/10
5,037,151 A 8/1991 Kameyama et al. ..... 294/81.55
5,119,585 A * 6/1992 Camp ..... 43/53.5
5,218,795 A * 6/1993 Horstketter ..... 52/125.5
5,480,201 A 1/1996 Mercer ..... 294/67.31
5,603,544 A 2/1997 Bishop et al. ..... 294/81.1
5,762,389 A 6/1998 Marler ..... 294/75

* cited by examiner

FRAME FOR LIFTING BEAMS AND OTHER ELONGATED LOADS

This application is based upon and claims priority from U.S. Provisional Application Ser. No. 60/437,840, filed Jan. 3, 2003, the contents of which is incorporated by reference.

BACKGROUND OF THE INVENTION

The present invention relates to a lifting frame assembly used with a hoist or crane for holding elongated beams, trusses and the like, which has a pair of spaced apart lifting frames mounted onto a spreader bar. The lifting frames have lift slides that support the beam and provide a spring load on the beam to be lifted for a selected amount of vertical travel of the spreader bar. The load lift slides also remain engaged with the beam being lifted under the spring load for a selected amount of lowering movement of the lift frame assemblies after the beam is supported on an object.

A problem arises in the construction industry when placing long trusses or beams (called beams for convenience in this specification), into position, in particular, in that the rigging is generally controlled by a crane operator in a cab some distance away from the actual placement. It is possible for a lifted load to unexpectedly hang-up on the surrounding structure before it is secured in its final position. This condition is difficult for the hoist operator to sense. If the crane continues to lower the frame, the lifting hardware will likely prematurely dis-engage from the load. If the now unsecured load dislodges from the surrounding structure, the load falls out of control. This can result in damage to the structure being built, and hazards to workers.

In the prior art there have been springloaded lifts of various designs, but generally the holders and rigging are fairly complex and do not provide for a direct, limited amount of spring load needed for ensuring proper operation.

SUMMARY OF THE INVENTION

The present invention relates a lifting or hoisting frame that is attached to a hoist for raising a load. As shown, the frame is lifted by a crane or similar hoist, and which as shown in one form, a spreader bar has lift frames pivotally mounted at opposite ends. The lift frames are formed as multiple parts, including a yoke that attaches to the spreader bar or hoist about a generally horizontal pivot.

The lift frame carried by a yoke includes an outer guide, formed as a tube or pipe in which an internal lift slide, as shown a sliding lift pipe is mounted. The lift slide has a beam holder or load support at a lower end and is mounted in a guide for limited vertical movement. The lift slide or sliding pipe is supported on a spring relative to the lift frame and guide for limited sliding from a retracted position to a stopped, extended position. When the lift slide is under load sufficient to overcome the spring force, it can slide from its retracted position relative to the yoke and lift frame guide downwardly a limited amount. The downward movement of the lift slide is limited by a stop acting between the lift slide and the guide.

The lower end of the lift supports a load holder, as shown a beam holder support frame that has a support base configured to mate with the shape of the beam or load to be lifted so the load center is along the central axis of the guide for the lift slide.

The beam holder frames are "C" shaped, that is, they have a horizontal top leg and a lower or base leg and a side bar joining the top and base legs. The side bar spaces the legs sufficiently so they can be moved over the top and bottom of the beam or load to be lifted and then when the frame is raised, the bottom leg engages the beam. The lifting force from the center axis of the spring and lift slide guide on the lift frame is along the center plane of the beams being lifted.

The spring supports for the lift slides will maintain a load on the beam holder frame against the lift surfaces of the load or beam as the lift slide moves from the time the load or beam holder frame is in a retracted position and first engages a beam, to the extended stopped position as the lift slide is loaded. As the spreader bar or other hoist is lifted by a crane, the spring load against the beam to be lifted increases until the lift slide or pipe reaches the stop, at which time the lift slide will no longer extend. The hoisting continues under a mechanical connection between the lift slide and the slide guide.

After the beam or load is carried to its intended location, and the spreader bar is lowered, and the holder frame that is supporting the beam will maintain contact in its supporting position on the beam after the beam is supported on an object until the lift slide moves under spring load to its retracted position as the spreader bar is lowered. The amount of lowering of the hoist or spreader bar after the beam is supported and before the holder frame no longer exerts a load against the beam so it can be released (which is after the slide reaches its retracted position) is sufficient so that an operator of a hoist or crane will notice if the beam has hung up prematurely and so the holder frame is retracting before the beam or load is properly seated. The spring-loaded lifting system serves to prevent release of the beam before it is properly seated because the hoist operator or a flagman can easily see the spring and lift slide retracting, which indicates to them that the load is supported by something other than the hoist line. There is ample warning to stop lowering, and then raise the hoist line until the load is once again supported totally by the hoist line.

This visual clue provided by the lift slide that the beam or load is no longer lowering, but that the spreader bar or hoist is lowering, insures that the beam or load can be safely dislodged from any snag or unwanted support.

When the beam or load being lifted is in its correct position, the spreader bar is lowered and the lift slides and beam holder frames will retract to their retracted position under spring load. Further downward movement of the spreader bar permits the beam holder frame to disengage from the beam so the beam holder frames can be removed.

The spring-loaded lifting system insures positive engagement of the lifted load until the deliberate release by the hoist operator. It also allows the hoist operator to automatically release the load at the desired time without the need for other personnel to gain access onto the lifted load to disconnect the lifting hardware. This greatly increases the safety and productivity of the erection process and lessens the likelihood of a load slipping from a snag if it is hung up.

The term "beam" as used herein is to be broadly interpreted and covers various beams, trusses, frames and other support structures that are hoisted into position for use.

DETAILED DESCRIPTION OF THE PREFERRED EMBODIMENTS

Figure 1:
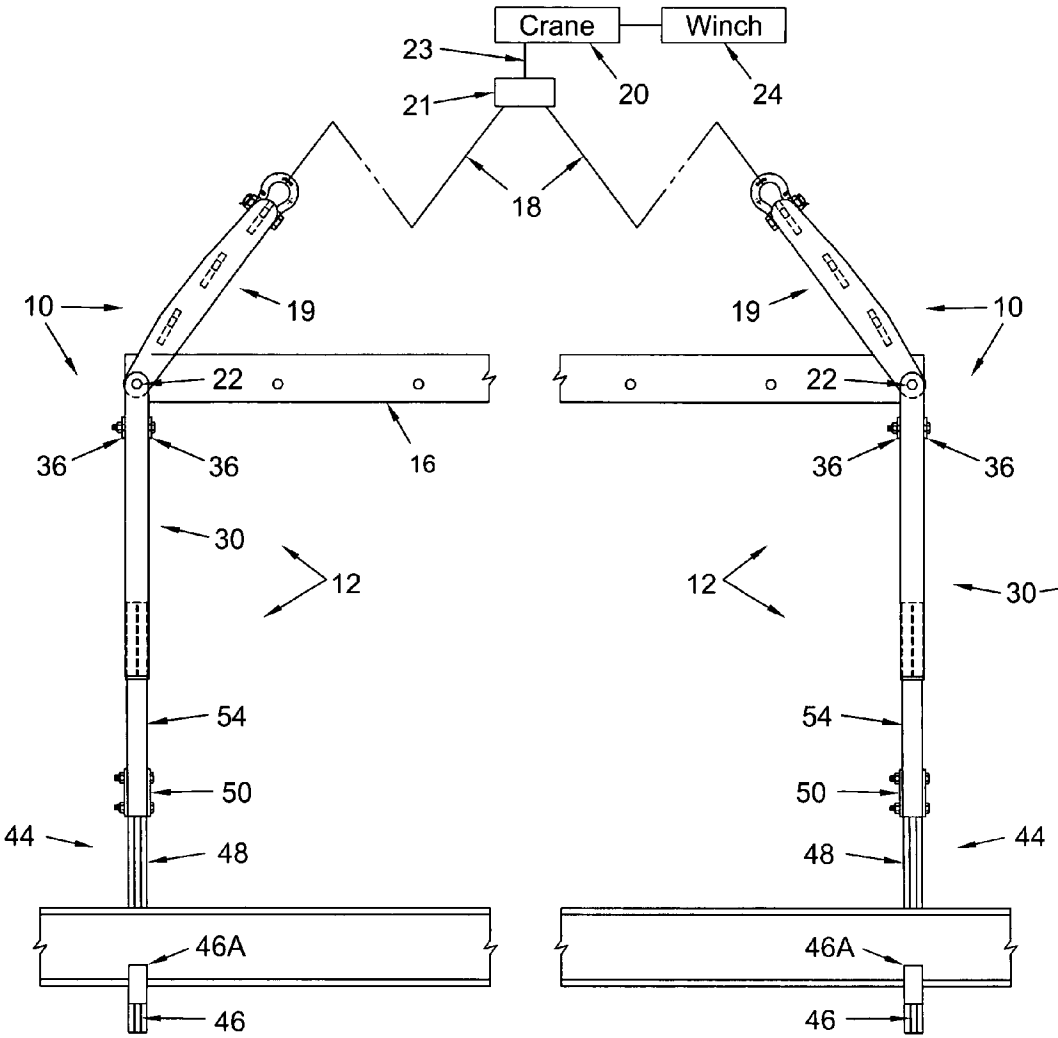
FIG. 1 is a schematic side elevational view of a typical rigging utilizing lift frames made according to the present invention.

Referring to FIG. 1, a lift rigging indicated generally at 10 comprises a pair of lift frame assemblies 12, which are pivotally mounted at opposite ends of a spreader bar 16, and which are used for lifting a beam 14. The spreader bar 16 is conventional, and the frame assemblies 12 are pivotally mounted about transverse pivots indicated at 22 to the opposite ends of the spreader bar. The spreader bar 16 is supported through suitable rigging such as cables 18 and connecting links 19. The links 19 are pivotally mounted on pivot 22 at the opposite ends of the spreader bar to form a sling that is in turn supported from a block 21 that is controlled for raising and lowering from a crane or hoist 20. The crane or hoist 20 has a controllable cable 23, which can be payed out or retracted with a drum on a hoist or winch 24.

Alternatively, the crane 20 can comprise a boom that would raise and lower directly for placing the spreader bar 16 in the desired location to properly position the beam or truss 14 on its desired supports on the building or other construction being assembled.

The support rigging can be conventional, and spreader bars are also conventional. The present invention relates to improvements in the pivoting end lift frame assemblies 12, which are used for supporting beam or load holders for holding the beam or load to be lifted in position.

Figure 2:
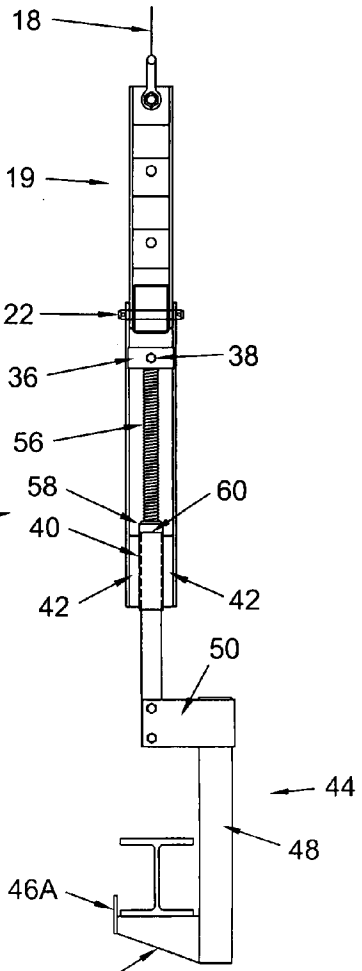
FIG. 2 is an end elevational view of FIG. 1.
Figure 4:
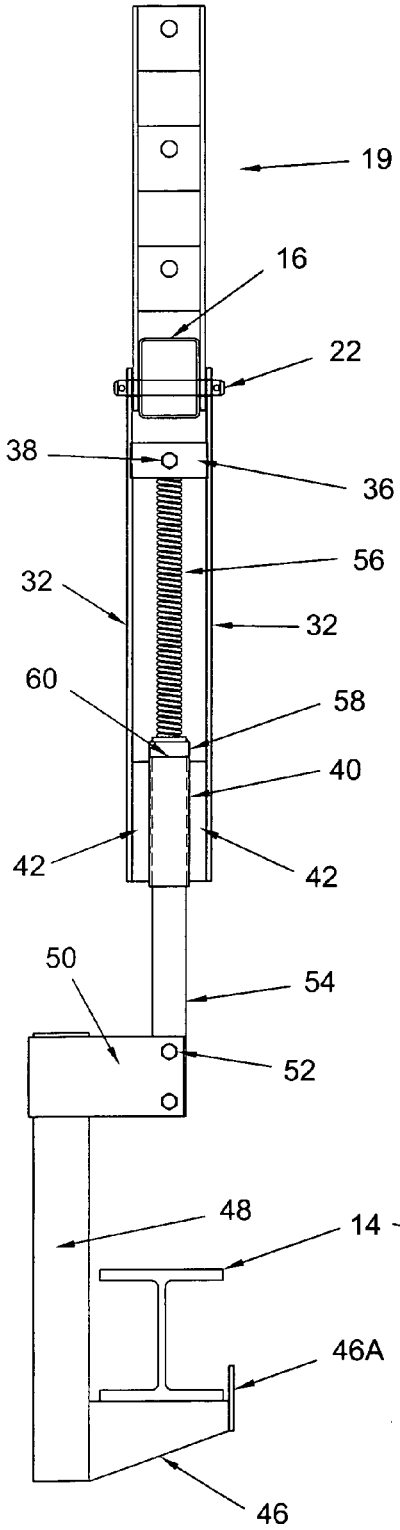
FIG. 4 is a side elevational view of the holder frame and yoke of FIG. 3.
Figure 3:
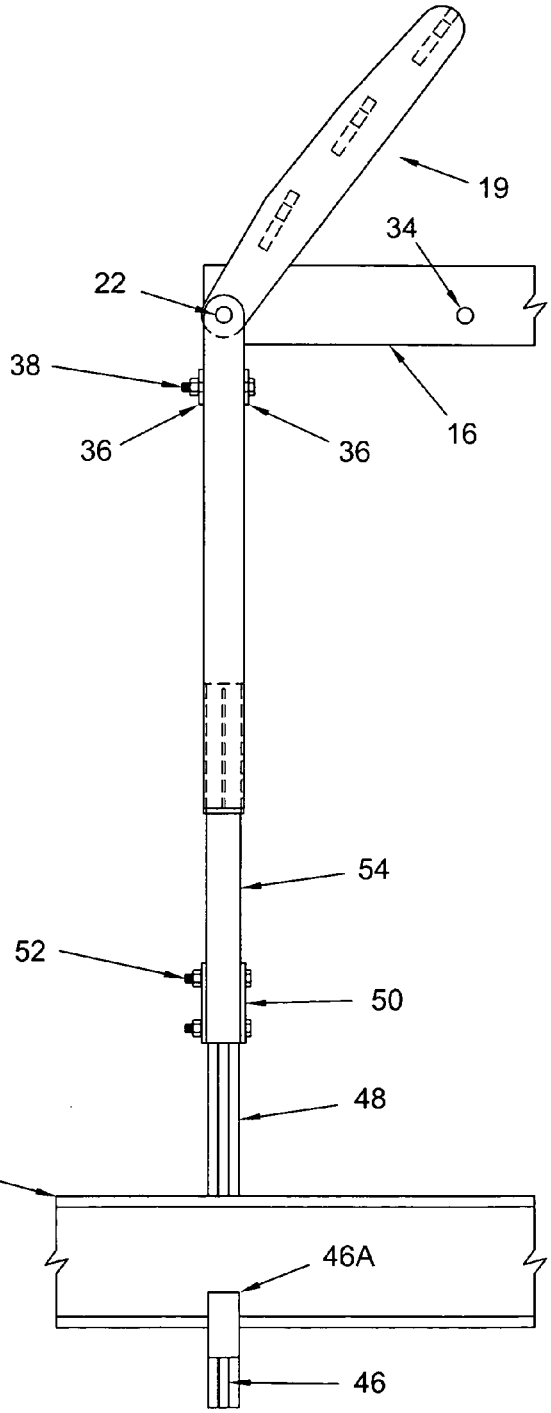
FIG. 3 is an enlarged front elevational view of a left hand end beam holder frame and supported lift slide, slide guide and yoke for connecting the frame to a spreader bar and rigging, with the lift slide in a retracted position.

As shown in more detail in FIGS. 2–12, the frame assemblies 12, 12 at opposite ends of the spreader bar 16 are mirror images of each other. The lift frame on the left hand side of FIG. 1 is illustrated in FIGS. 3 and 4. FIGS. 2, 5–7 and 10–12 show the lift frame assembly 12 on the right hand end of FIG. 1. Each of lift frame assemblies 12 comprises a yoke or frame assembly 30 made up of a pair of spaced apart straps 32, 32 which straddle the spreader bar 16, as shown in FIGS. 3 and 4, and are held in position with the pivot 22. The pivot 22 permits pivoting of each yoke 30 about a horizontal axis. The yokes and supported components thus will hang vertically under gravity.

The spreader bar 16 has a series of cross holes 34 so that the yoke 30 can be moved to different positions, if different lengths of beams are being lifted. The straps 32, 32 are held together with cross members 36 adjacent the upper end of the yoke. The cross members 36 are spaced apart by the width of straps 32, to leave a space between them, and a pin 38 is supported on the cross members.

The lower portion of the yoke or frame assembly 30 supports an outer slide guide tube or sleeve 40 that is supported relative to the straps 32, 32 with suitable braces 42, to center the lift slide guide tube or sleeve 40 in position. As can be seen, the guide 40 extends only partially along the length of the yoke.

A beam or load holder frame 44 is made in C-shape with a lower or base beam support leg 46, a side bar or upright leg 48, and a top leg 50. The base leg 46 has an edge shape to mate with a beam 14 being lifted to hold it in place. Adapters on the beam support leg can be used for different beams or trusses.

The upper leg 50 is suitably attached, for example with bolts 52, to an elongated lift slide 54, as shown a tube or pipe, that is slidably mounted within the lift slide guide 40, and extends parallel to and between the plates 32, 32.

The lift slide 54 is urged upwardly by a spring or biasing member 56 that is on the inside of the tubular lift slide pipe 54. Spring 56 has one end hooked to the bolt 38, supported on the cross plates 36 near the upper end of the yoke 30. The other end of spring 56 is hooked on a cross bolt 52 that is supported at the lower end of the lift slide 54. The spring 56 is used for providing a spring load for supporting the beam or load holder frame 44. The biasing member can be an elastomeric member or any type of spring, including a compression spring, if desired.

Figure 7:
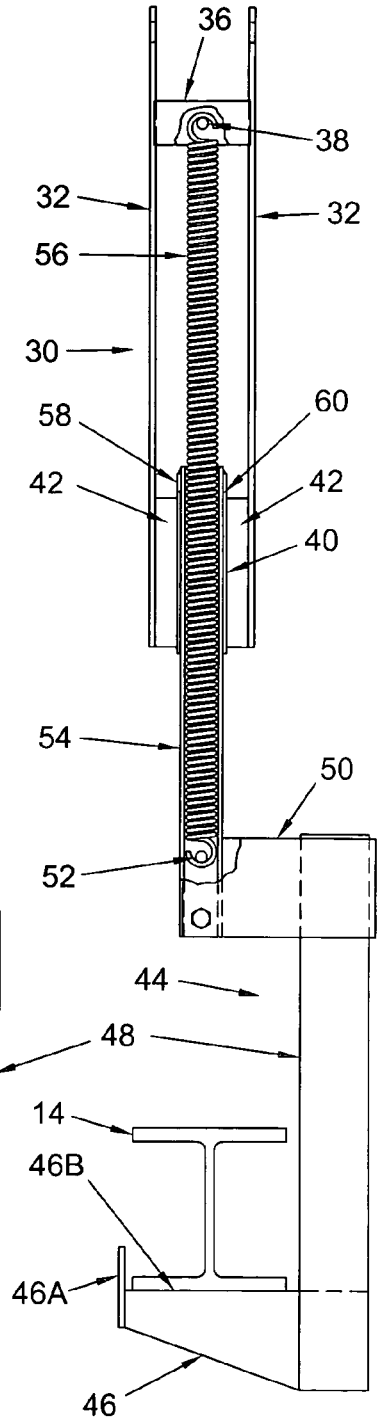
FIG. 7 is a side elevational view of the beam holder frame in its extended position such that the load is totally supported on a stop on the lift slide engaging the top of the slide guide.

The lift slide 54 has a bearing head or stop ring 58 near its upper end, that is of size to stop against an upper surface 60 of the lift slide guide sleeve 40, so that the amount of extension of the spring 56 is limited to the travel of the lift slide between the retracted position shown in FIG. 3 and the extended position shown in FIGS. 2 and 7, where the spring 56 is extended and the bearing head or stop ring 58 is engaging the top end of sleeve 40. If a compression spring is used, it can be compressed fully to form a stop in the extended position.

The lower beam support leg 46 of the beam holder frame 44 is formed to center the beam being held, so that the weight center (center of gravity) of the beam is on the axis of the lift slide 54. There is a direct load on the axis of the lift guide sleeve 40 and lift slide 54, so that there will not be any binding or cocking of the lift slide relative to the lift slide guide 40 due to the weight of the beam.

The spring 56, as shown, is a tension spring that is easily mounted on its opposite ends and will extend a sufficient amount for permitting the desired travel of the beam holder frame 44 relative to the yoke assembly 30 to accomplish the purposes of retaining the beam in the frame for a selected distance of travel downwardly of the cross bar after the beam is supported in place, whether it is supported in its desired location, or is hanging up on some obstruction. Other types of springs can be used, such as compression springs, electronic members or the like. The spring is a biasing member that provides a resilient force.

Figure 5:
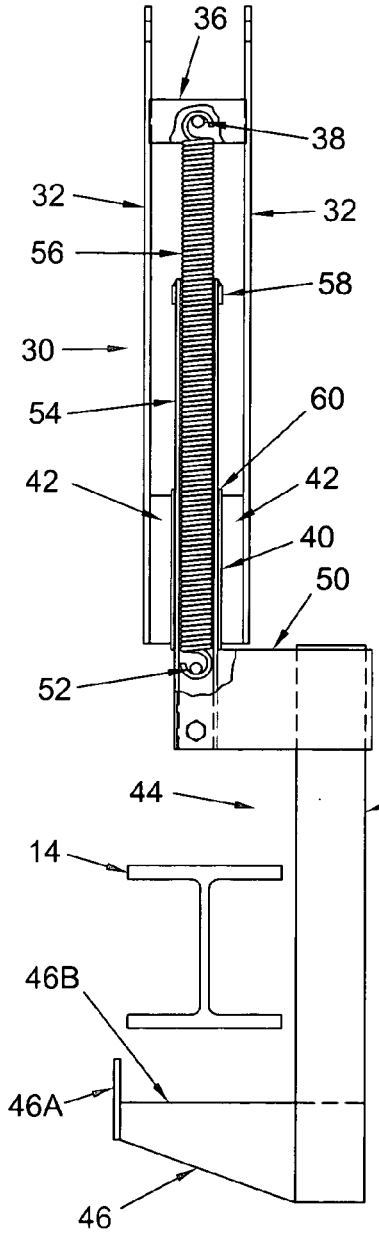
FIG. 5 is a side view of the lifting frame showing the beam holder frame retracted and positioned about to engage a beam.
Figure 6:
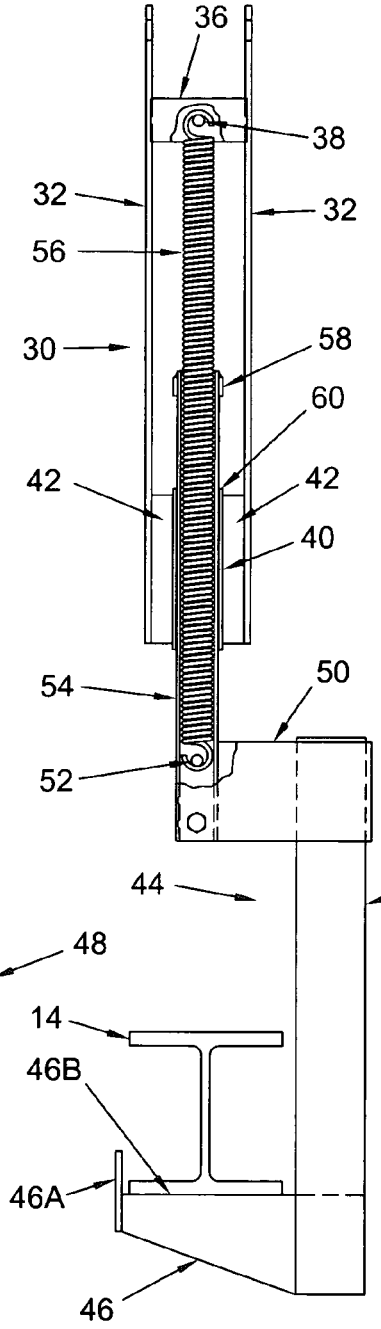
FIG. 6 is a side elevational view of the beam holder frame of FIG. 5 shown in the position engaging the beam and with the lift slide partially extended under spring load.

FIGS. 5, 6 and 7 show the beam holder frame 44 in different positions during use, relative to the beam illustrated at 14. FIG. 5 shows the beam holder frame and lift slide in a full retracted position held by the spring 56, and with the beam holder frame moved to underlie the beam supported at its location from which it is to be lifted. The lower or base member 46 is made to slip under the beam, and it can be seen at an upright stop 46A can be used for preventing the beam from sliding off the outer end of the lower or base member 46.

Figure 11:
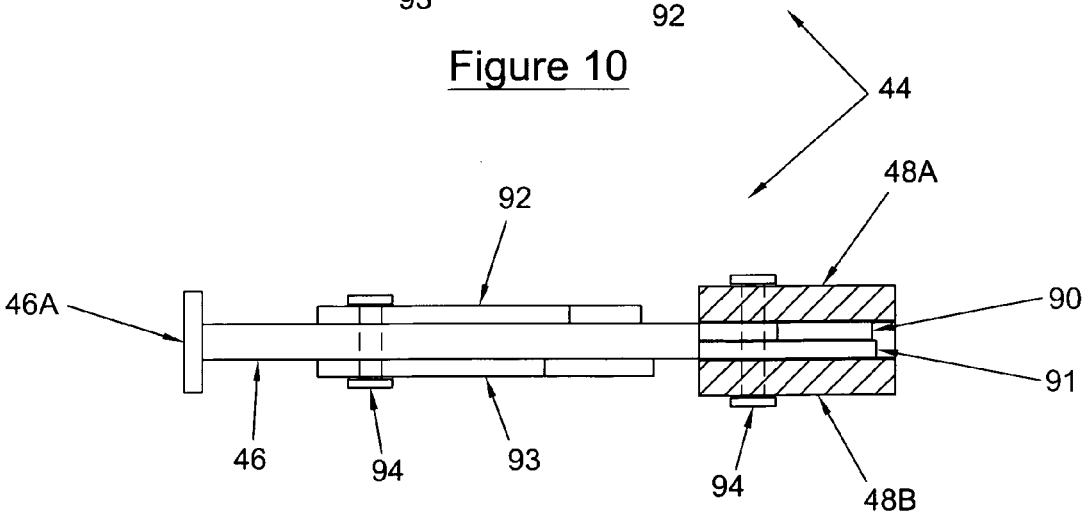
FIG. 11 is a sectional view taken on line 11—11 in FIG. 10.

It also can be seen that the upright leg 48, which is made of two spaced plates 48A and 48B, as shown in FIG. 11, has a pivotally mounted adapter indicated at 91, that is retracted out of the way in FIGS. 5, 6 and 7, also, the lower or base member 46 has another adapter or member 93 that can be pivotally mounted to provide for different supporting configurations for a beam. The beam 14, as shown, is an I beam, and its lower flange is substantially planar. The lower flange rests against the upper edges 46B of the lower support member 46.

FIG. 6 shows the beam 14 on the base member 46 with the lift slide supported by the spring 56. The spring 56 is partially extended so that the beam or load holder frame 44 is moved away from its fully retracted position, but the beam is preferably not yet lifted from its support. Part of the lift slide 54 extends out below the guide sleeve 40.

Figures 8, 9:
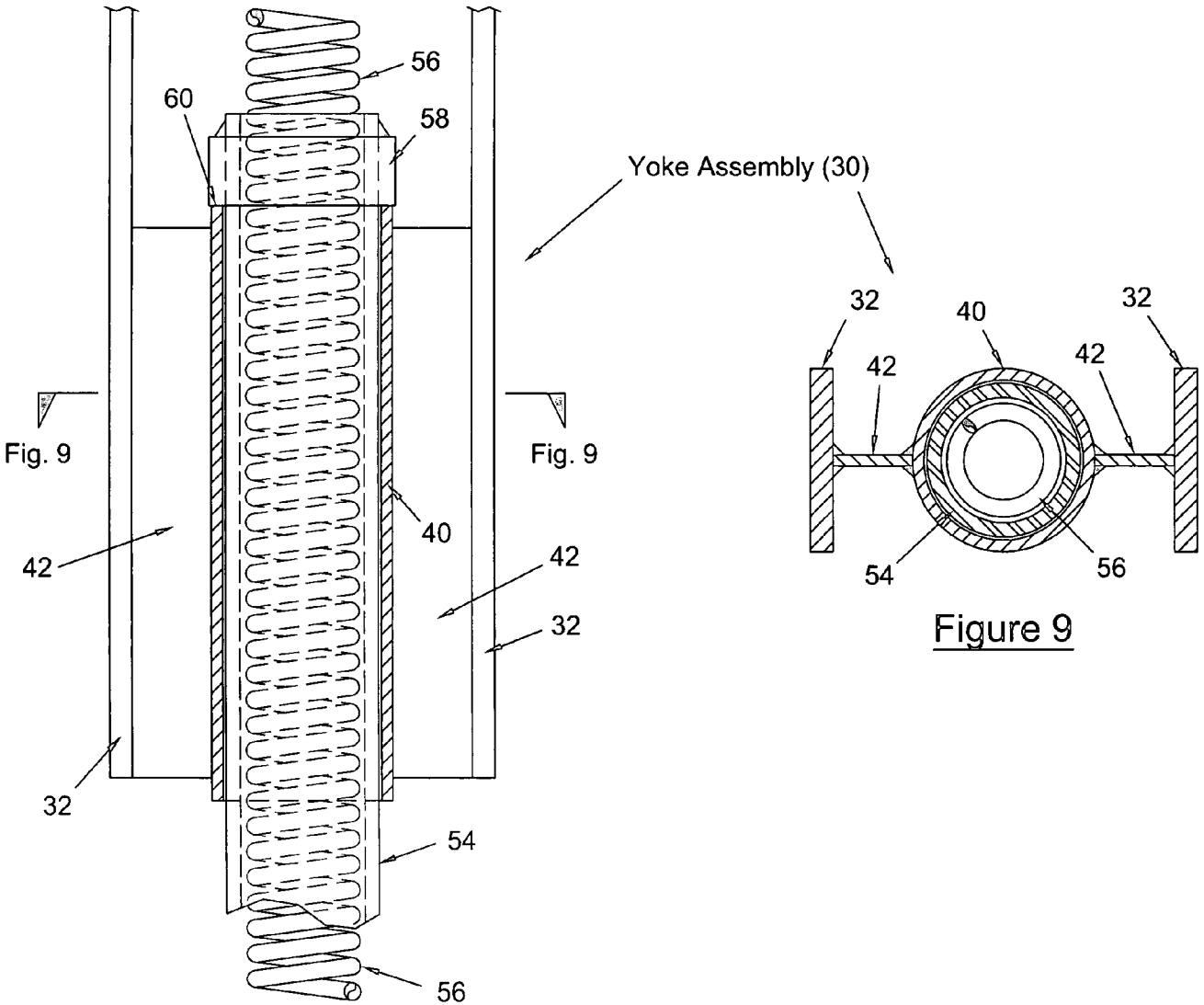
FIG. 8 is an enlarged view showing a lift slide supporting the beam on the lift slide guide with the lift slide guide in cross section.
FIG. 9 is a sectional view taken as on line 9—9 in FIG. 8.
Figure 10:
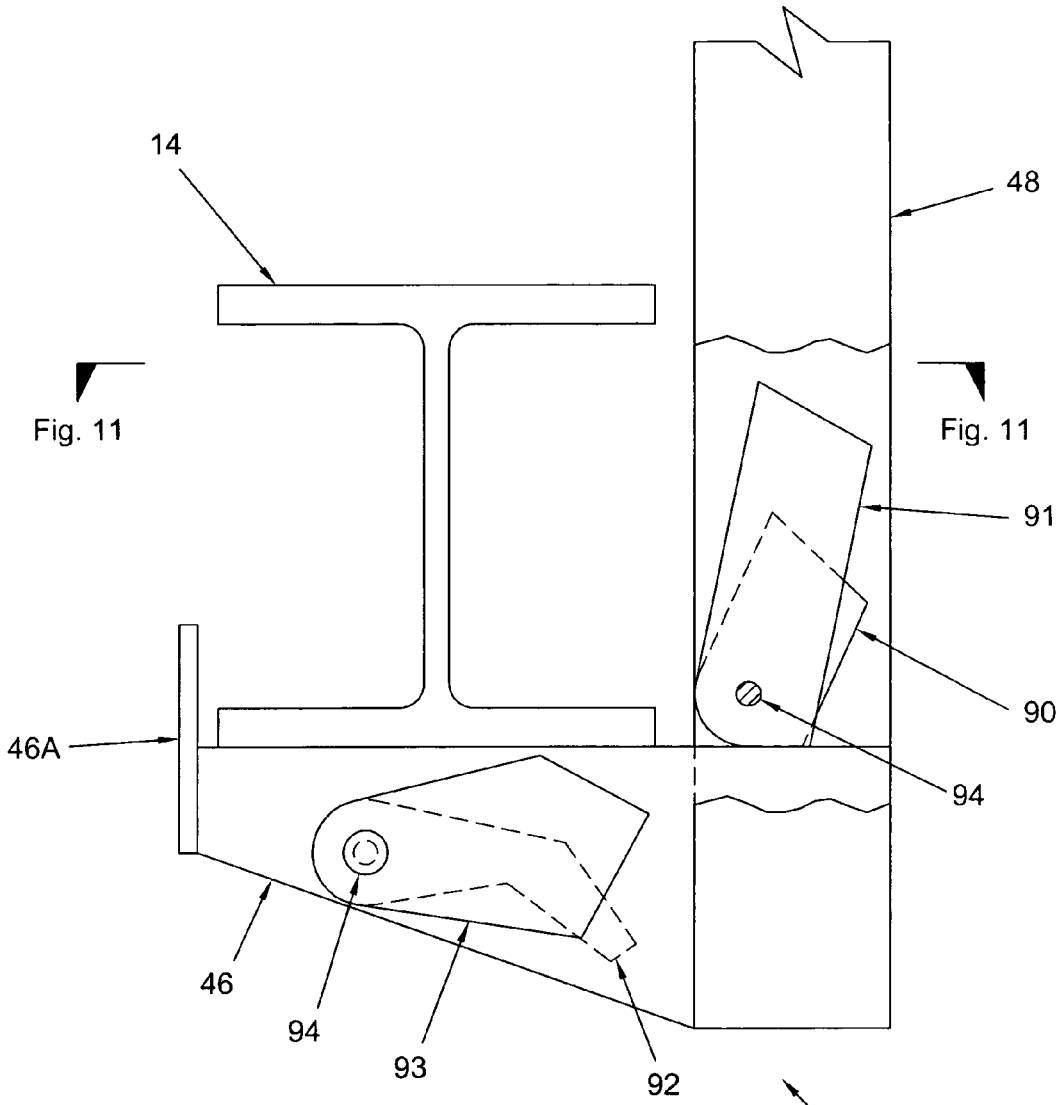
FIG. 10 is a side view showing the beam holder frame supporting a different size beam.

FIG. 7 shows the beam or load holder frame 44 with the lift slide in its fully extended, stopped and working position, with the bearing head or stop ring 58 resting against the upper edge 60 of the slide guide 40, as can be seen in greater detail in FIG. 8.

In this position, the beam or load 14 will be held mechanically, or without any spring loads supporting it, so that it will be stable for movement to its working position.

The position of the slide and spring shown in FIG. 6, can occur if the beam 14 is held up on some supporting structure as the beam is being lowered, and the lift slide 54 starts to retract. The difference in extension of the lift slide 54 from guide 40 can be noticed by a flagman, or by the crane operator, particularly if the lift slide is colored a fluorescent paint color, or has other distinctive indicia on its surface. If the beam 14 is not in its desired, final location, the crane operator will be alerted and know that the beam is hung up, and can stop the lowering operation and lift the beam from this position. The obstruction can be cleared, and the beam is again lowered.

Figure 12:
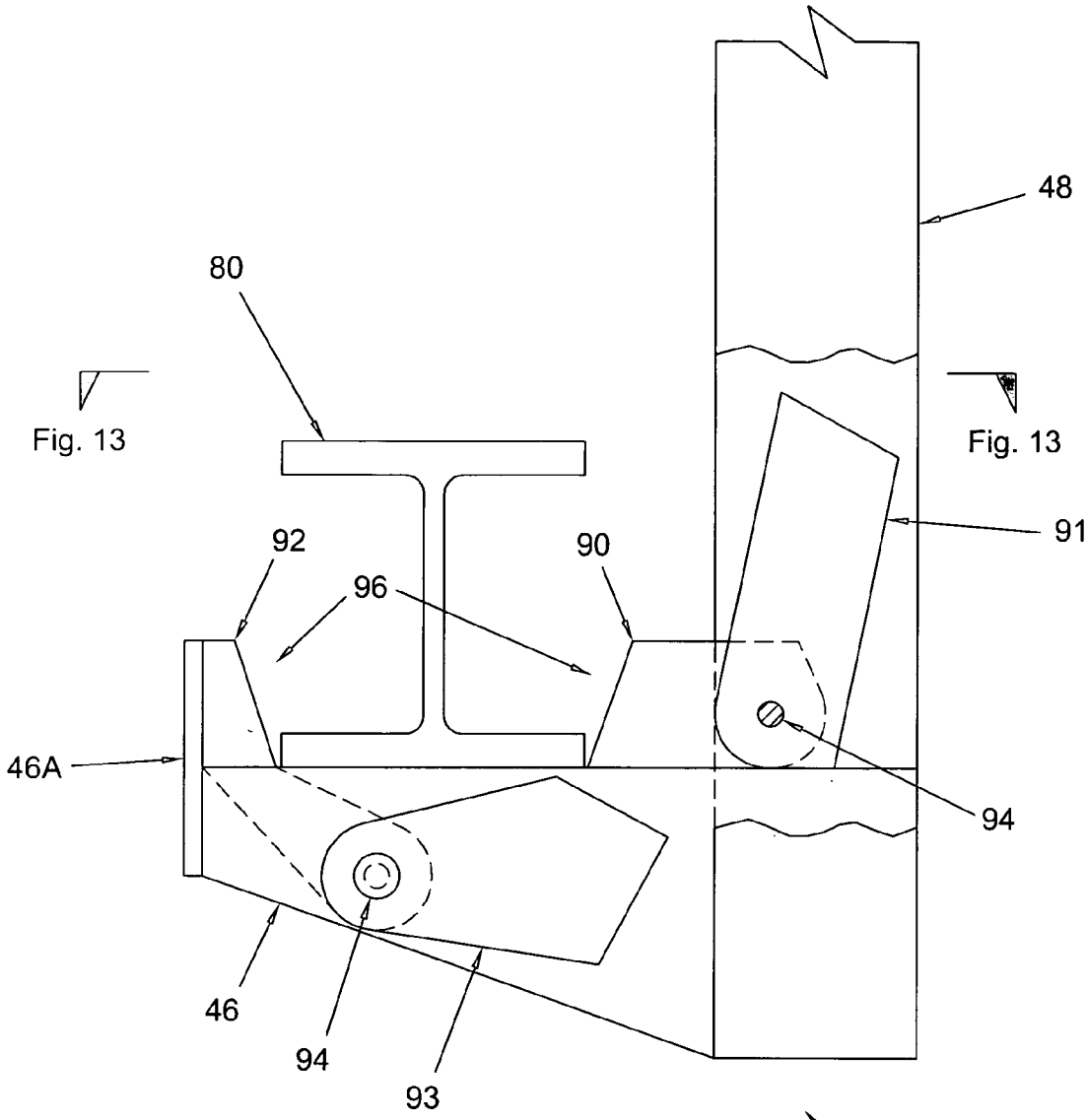
FIG. 12 is a side view of the beam holder frame showing the beam holder frame converted with adapters to hold a truss.
Figure 13:
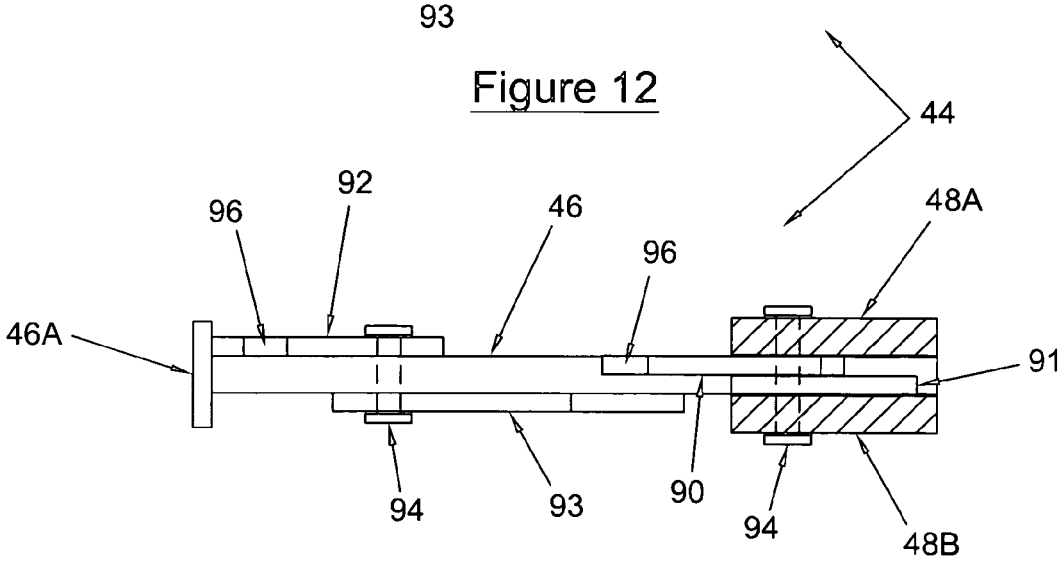
FIG. 13 is a sectional view taken on line 13—13 in FIG. 12.

FIGS. 12 and 13 show a different type of beam 80 on the beam holder, that is a different size, and which beam will rest upon the lower leg or lower member 46 forming the beam lift member. The beam 80 will be held between a pivotally mounted adapter strap 92 moved to a working position, with adapter strap 93 left in its retracted position, and an adapter 90 pivotally supported on leg 48 and moved to its working position. The beam or load 80 is held centered between the upright side leg 48 and the stop member 46A at the outer end of lower leg 46. The two adapters form a slot 96 with inwardly tapered side walls to center the beam 80 as the beam rests on member or leg 46.

Figure 14:
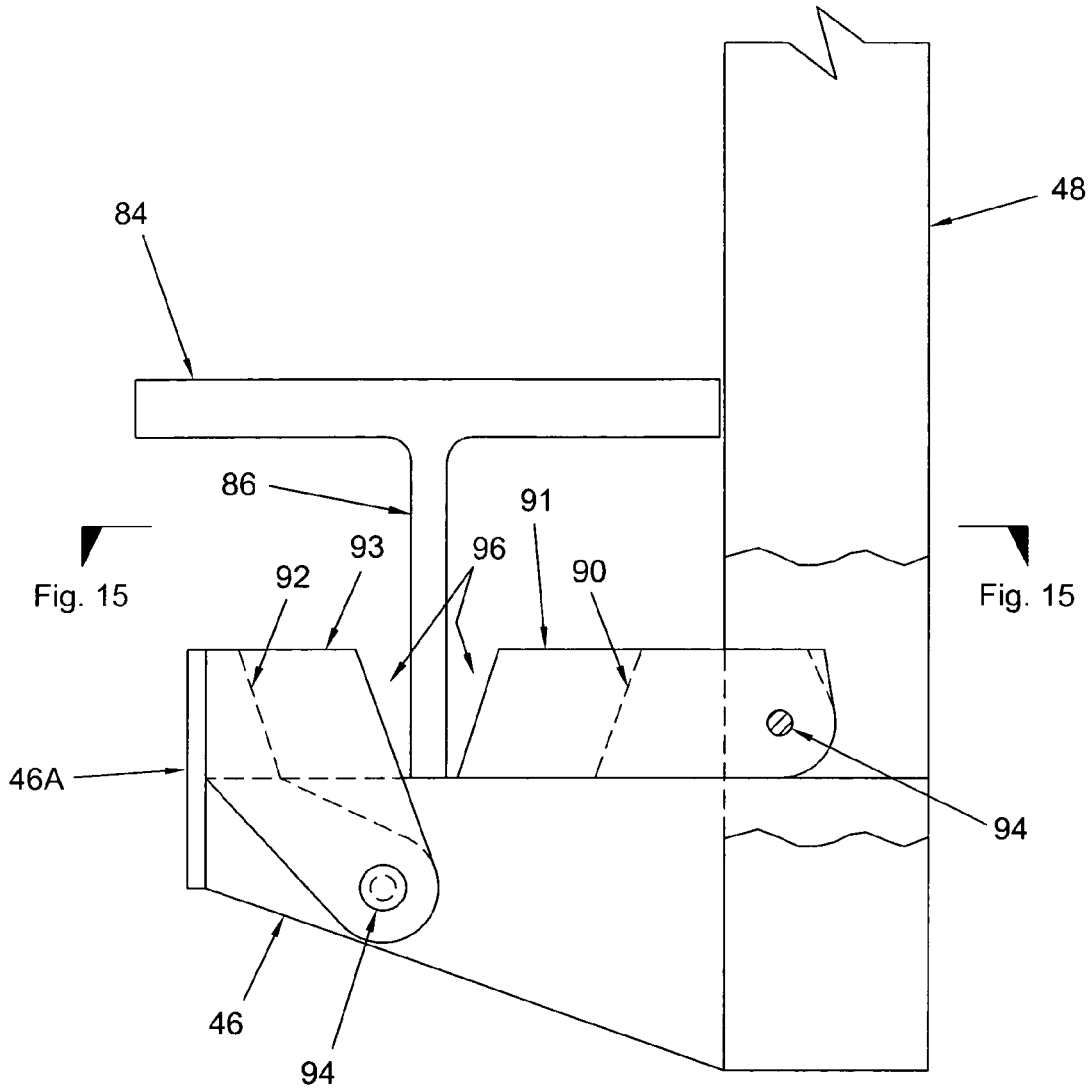
FIG. 14 is a side view of the beam holder frame of FIG. 12 with adapters in place to hold a truss.
Figure 15:
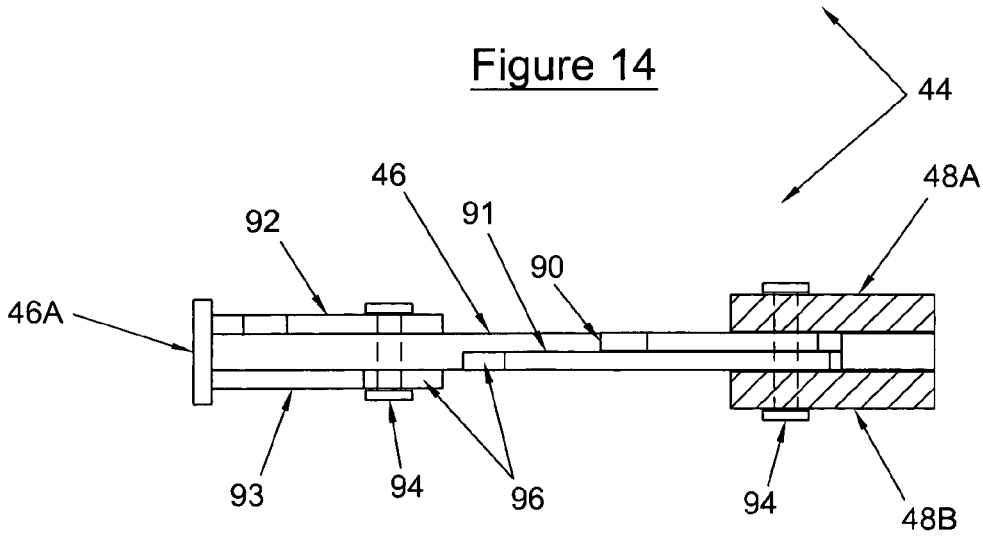
FIG. 15 is a sectional view taken on line 15—15 in FIG. 14.

FIGS. 14 and 15 show a truss beam 84 that is generally T-shaped and has a depending web 86. In this position, the adapter strap 91 has been pivoted about is pivot 94, to rest on the beam support member 46. The adapter strap 93 pivots upwardly and can rest against the outer flange 46A and be held in position. The strap adapters 91 and 93 have end surfaces forming an upwardly open, tapered side wall slot 96, so that the web 86 can slide into a seated position with the web 86 then centered on the axis of the lift slide 54 and guide 40.

The lower beam support leg 46 and the upper leg 50 are spaced vertically sufficiently to insure the beams 14, 80 or 84 will fit easily in the recess formed between legs 46 and 50.

If one end of the beam being lifted is hanging up on an obstruction, the travel and force of the spring 56 and the slide 54 insures that the beam will not be released from the beam support leg 46 until the spreader bar 16 has lowered a significant amount (see FIG. 6). If the beam is hanging up, and then slips or becomes loosened, the beam support leg 44 will not have disengaged from the beam, and the beam support leg 44 will remain engaged until the lift slide 54 extends so that the stop collar or bearing head 58 engages the end 60 of the lift slide guide sleeve 40. If the beam continues to be hung up on something, the extension of lift slide 54 above guide 40, or the reduction of extension of lift slide 54 below the guide will be noticed by the crane operator or flagman and lowering of the beam will be stopped.

The lift slide 54 can be colored with fluorescent, bright paint, so that as it would extend out of the guide sleeve 40, particularly when it is hung up on an obstruction, the visual information would be enhanced.

The loading on the beam holder frames is in line with the center of the spring, and the center of the sliding parts, so that there is no substantial likelihood of binding or excessive wear. The slide guides and lift slide tubes can be lubricated if desired, or coated with low friction material. The holder frame assembly is relatively low cost, yet reliable.

The length of the spreader bar 16 can be adjusted as desired, and the amount of extension of the lift slide 54 and spring can also be controlled. Vertical sliding movement in the range of 2 feet can be accommodated.

It is apparent that the frame assembly 30, including the guide tube 40, lift slide 54 and beam or load holder frame 44 can be used as a simple lift frame assembly, and directly supported on a hoist, through a suitable cable, chain or other connection.

Although the present invention has been described with reference to preferred embodiments, workers skilled in the art will recognize that changes may be made in form and detail without departing from the spirit and scope of the invention.

What is claimed is:

1. A lifting frame assembly for a hoist having a first end adapted to be attached to the hoist, the frame assembly including a guide raisable and lowerable with the frame assembly by the hoist when a load is to be lifted, a lift slide slidably mounted on said guide for movement along a central guide axis, a biasing member connected between the frame member and the lift slide resiliently loading the lift slide to move along the guide in a direction toward the first end of the frame assembly to a retracted position, a stop to limit the lift slide from moving relative to the guide in a direction away from its retracted position under gravity acting on a load carried by the lift slide when the frame assembly and the guide are lifted by the hoist, said lift slide comprising a load support frame having a generally horizontal leg with a substantially straight load support surface having a shape complimentary to a surface of a load to be lifted to receive and support the load when the load is oriented in a selected position for lifting, adapter members mounted on the load support frame comprising pivoting straps that are mounted on portions of the load support frame and that are adapted to rest on the load support to provide a guide receptacle for holding the load substantially centered on the central guide axis of the guide, said pivoting straps are moveable to a load retaining position projecting above the load support surface, and have inclined surfaces extending upwardly from the load support surface at opposite ends of the load support surface and inclining in directions to form a load receiving pocket therebetween.

2. The lifting frame of claim 1, wherein the load support frame has an upright bar connected to the horizontal leg and wherein the pivoting straps comprise a first pivoting strap being pivoted to the upright bar, and a second pivoting strap being pivoted to the generally horizontal leg and wherein the second pivoting strap pivots to a load retaining position in opposite direction of rotation from the direction of rotation of the first pivoting strap toward its loading retaining position.

3. A load support for a hoist assembly comprising an elongated spreader bar having opposite ends, a separate pivoting frame member at each of the opposite ends of the spreader bar that depends from a pivot connections to the respective ends of the spreader bar, each frame member including a guide member on the respective pivoting frame member, a lift slide mounted on the guide member for slidable movement relative thereto, the lift slide being adapted to lift a load carried thereon when the frame member and guide member are lifted, a biasing member between the frame member and the lift slide that resiliently resists extension of the lift slide from gravity on a load carried by the lift slide from a retracted position as the frame member and guide member are raised, and a stop between the guide member and the lift slide to limit the amount of extension of the lift slide relative to the guide member, each frame member including a support member on the lift slide for supporting an elongated beam that extends between the frame members at opposite ends of the spreader bar, said support members being generally C-shaped to permit mounting a beam to be lifted with a center thereof substantially along a center axis of the lift slide of both frame members.

4. The load support of claim 3, wherein the lift slide extends through the guide member.

5. The load support of claim 4, wherein said biasing member urges the lift slide in a direction to maintain contact of the support members and a beam being lifted for a selected distance of extension of the lift slide.

6. The load support of claim 3, wherein each guide member comprises a tubular sleeve, and the associated lift slide extends from the respective guide member as the lift slide moves as the guide member is lifted to raise a load carried by the lift slide, the lift slide carrying indicia that is exposed in the lift slide retracted position and which moves past a reference mark on the guide member as the lift slide extends from its retracted position.

7. The load support for a hoist assembly of claim 3, wherein said hoist assembly comprises a spreader bar that is elongated and has opposite ends, a separate frame member pivotally mounted at opposite ends of the spreader bar, wherein each frame member includes a support member for supporting an elongated beam between the frame members at opposite ends of the spreader bar, said support members being generally C-shaped to permit mounting a beam to be lifted with a center thereof substantially along a center axis of the lift slide of both frame members.

* * * * *